US006499968B2

(12) United States Patent
Young

(10) Patent No.: US 6,499,968 B2
(45) Date of Patent: Dec. 31, 2002

(54) INTEGRAL PUMP AND CONTROL VALVE

(76) Inventor: Brian William Young, Dept. of Civil Engineering, PNG University of Technology, PMB Lae, MP 411 (PG)

( * ) Notice: Subject to any disclaimer, the term of this patent is extended or adjusted under 35 U.S.C. 154(b) by 0 days.

(21) Appl. No.: 09/777,339

(22) Filed: Feb. 6, 2001

(65) Prior Publication Data

US 2002/0106291 A1 Aug. 8, 2002

(51) Int. Cl.[7] ..... F04B 35/00; F04B 53/10; F01L 31/00

(52) U.S. Cl. ..... 417/403; 417/535; 417/536; 91/330

(58) Field of Search ..... 417/403, 535, 417/536; 91/218, 330, 38

(56) References Cited

U.S. PATENT DOCUMENTS

| | | | | |
|---|---|---|---|---|
| 4,029,440 A | | 6/1977 | Olsen | 417/403 |
| 4,659,294 A | * | 4/1987 | Barthomeuf | 417/397 |
| 4,780,064 A | * | 10/1988 | Olsen | 417/397 |
| 5,470,209 A | * | 11/1995 | Hartley et al. | 417/401 |

FOREIGN PATENT DOCUMENTS

WO WO 90/08896 8/1990

OTHER PUBLICATIONS

Young, B.W. (1999) A ram pump primer. Environmental Papua New Guinea—*Collected Papers Series* v. 1, ERMC, PNGUT month of publication not available, only year given.

Young, B.W. (1998) Generic design of ram pumps. Proceedings of the Institution of Mechanical Engineers, Part A: *Journal of Power and Energy,* v212 (A2), 117–124. Month of publication not available, only year given.

Young, B.W. (1997) Ram Pumps: A State of the Art Report. *ImechE/Brunel Univ. Energy and Environment Conf.,* Cyprus. Month of publication not available, only year given.

Young, B.W. (1997) Design of homologous ram pumps, Transactions of the American Society of Mechanical Engineers, *Journal of Fluids Engineering,* v119, n2, 360–365. (Jun. 1997).

Young, B.W. (1997) Getting the best out of a ram pump. *AMA Journal,* v28, n4, pp29–34. Month of publication not available, only year given.

Young, B.W. (1996) Simplified analysis and design of the hydraulic ram pump, Proceedings of the Institution of Mechanical Engineers, Part A: *Journal of Power and Energy,* v210 (A5), 295–303. Month of publication not available, only year given.

Young, B.W. (1996) Sizing ram pumps. Proceedings of the Institution of Mechanical Engineers, Part A: *Journal of Power and Energy,* v210 (A4), 245–248. Month of publication not available, only year given.

Young, B.W. (1996) System designs for the Platypus ram pump, *Agricultural Engineering Australia,* v25, n1, pp13–18 month of publication not available, only year given.

Young, B.W. (1995) Design of hydraulic ram pump systems. Proceedings of the Institution of Mechanical Engineers, Part A: *Journal of Power and Energy,* v209 (A4), 313–322. Month of publication not available, only year given.

* cited by examiner

*Primary Examiner*—Charles G. Freay
*Assistant Examiner*—Michael K. Gray
(74) *Attorney, Agent, or Firm*—Flynn, Thiel, Boutell & Tanis, P.C.

(57) ABSTRACT

A pumping unit, particularly for water supply in remote areas of the world, comprising a pump, control valve and tipping bucket mechanism enclosed in a single housing. The pumping unit is double-acting and, does not demand the presence of a drive pipe. The pump and the automatic control valve are powered by the potential energy of the supply and an independent power source is not necessary or required. The frequency at which the unit operates may be varied by adjustment of the supply of water to the tipping bucket.

10 Claims, 3 Drawing Sheets

INTEGRAL PUMP AND CONTROL VALVE

FIELD OF THE INVENTION

This invention relates to a compact integral reciprocating double-acting pump and automatic control valve forming a pumping unit which is powered only by the potential energy of the supply. The pumping unit does not require the installation of a drive pipe for operation.

BACKGROUND OF THE INVENTION

Similar devices are known but suffer from disadvantage that they require a drive pipe to be installed which needs additional space on site.

SUMMARY OF THE INVENTION

An object of this invention is to pump water for domestic use, irrigation, watering stock and other purposes in remote situations when electrical power is not available and the use of fossil-fueled generated power is to be avoided for economic or environmental reasons. Optionally, this type of pump may also be used for water supply wherever an appropriate source of natural energy is available as an alternative to incurring the capital, running, maintenance and depreciation costs of an independent power source.

Accordingly, this invention provides a pumping unit consisting of two high pressure cylinders and a double-acting low pressure cylinder all in-line and an automatic five-port control valve, which can be of the rotary, slide or spool type, operated by a tipping bucket. The tipping bucket is served by a small flow of water bled from the main supply. The power required to operate the pump unit is derived solely from the source of supply water situated at a small elevation above the pump unit.

The frequency of operation of the control valve and thus of the pump may be varied by adjusting the rate of flow of water into the tipping bucket.

The compact unit is enclosed in a single housing and does not require a drive pipe.

The delivery pressure and delivery flow provided by the pump unit is dependent only upon its size and geometry. The operation is automatic and quiet.

Preferably the pumping unit is made of metal or a combination of metal and plastics.

BRIEF DESCRIPTION OF THE DRAWINGS

A preferred embodiment of the invention will now be described with reference to the accompanying drawings in which.

DETAILED DESCRIPTION

Figure 1:
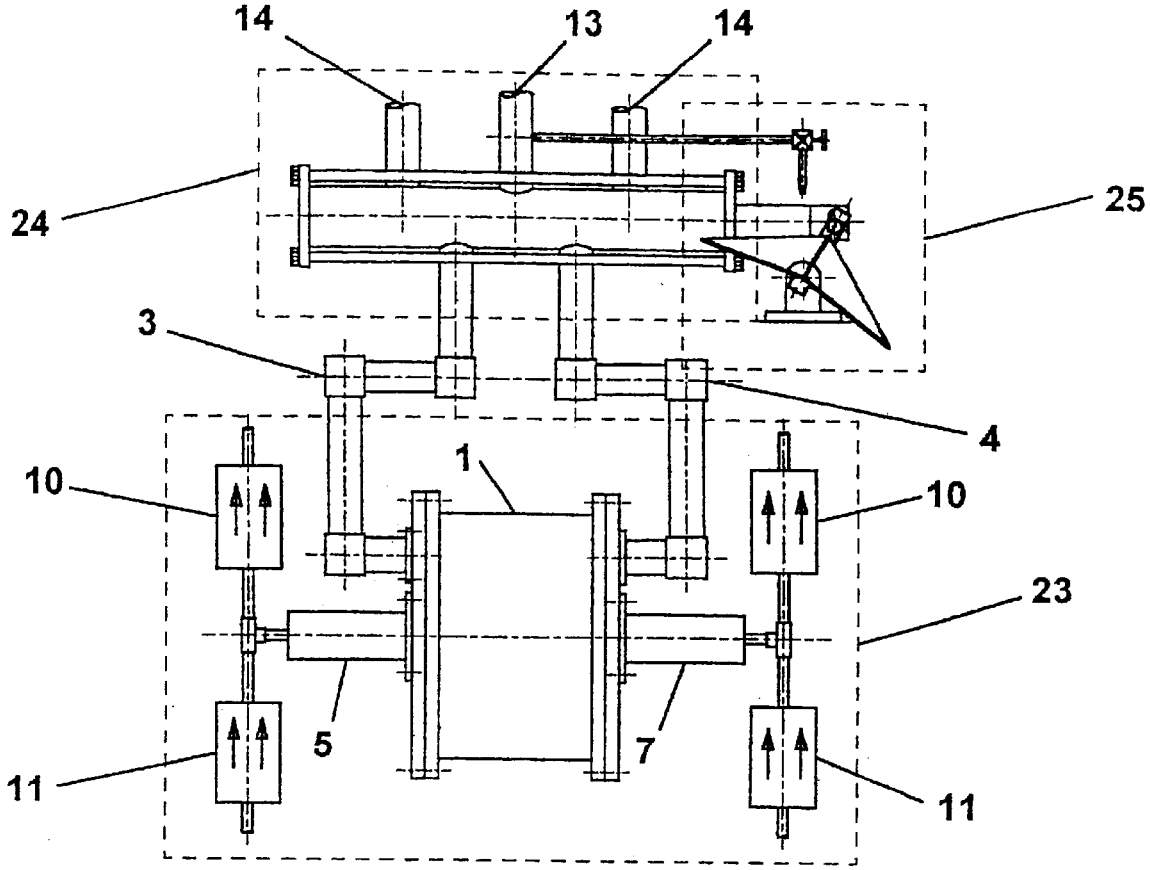
FIG. 1 is a side view of the pumping unit.
Figure 2:
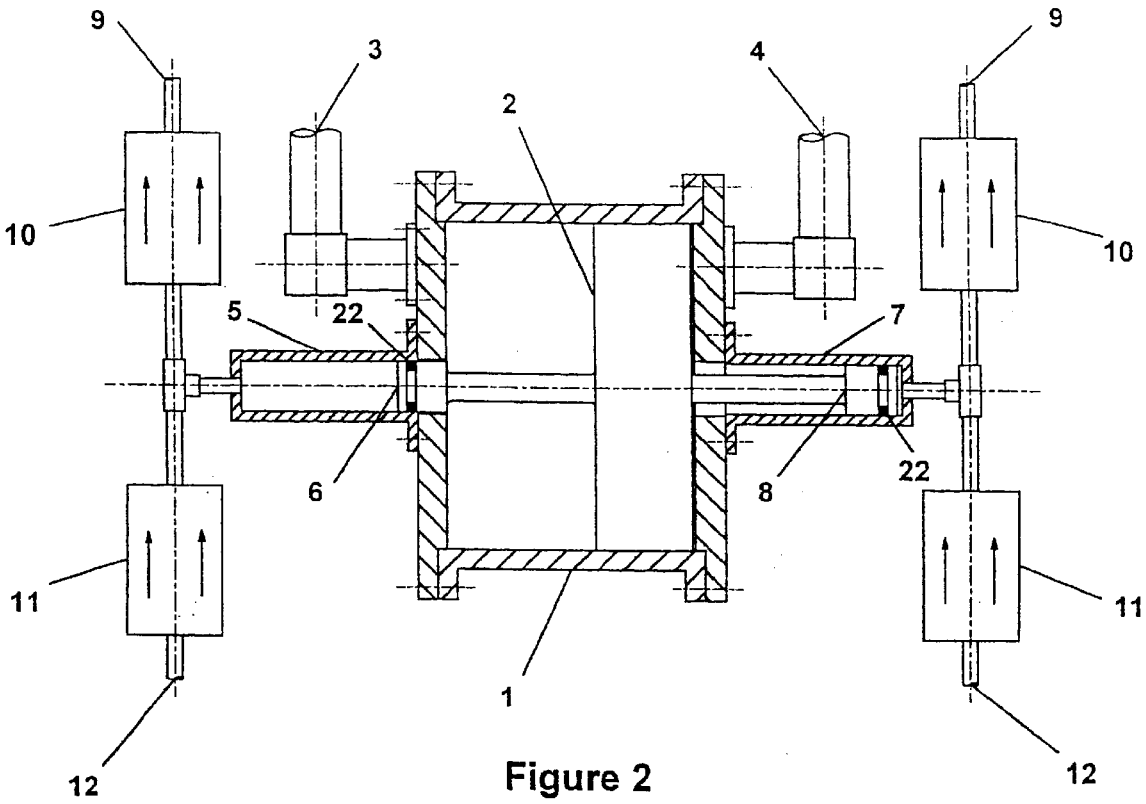
FIG. 2 is a sectional side view of the double-acting pump showing high and low pressure cylinders, suction and delivery non-return valves and suction and delivery pipes.
Figure 3:
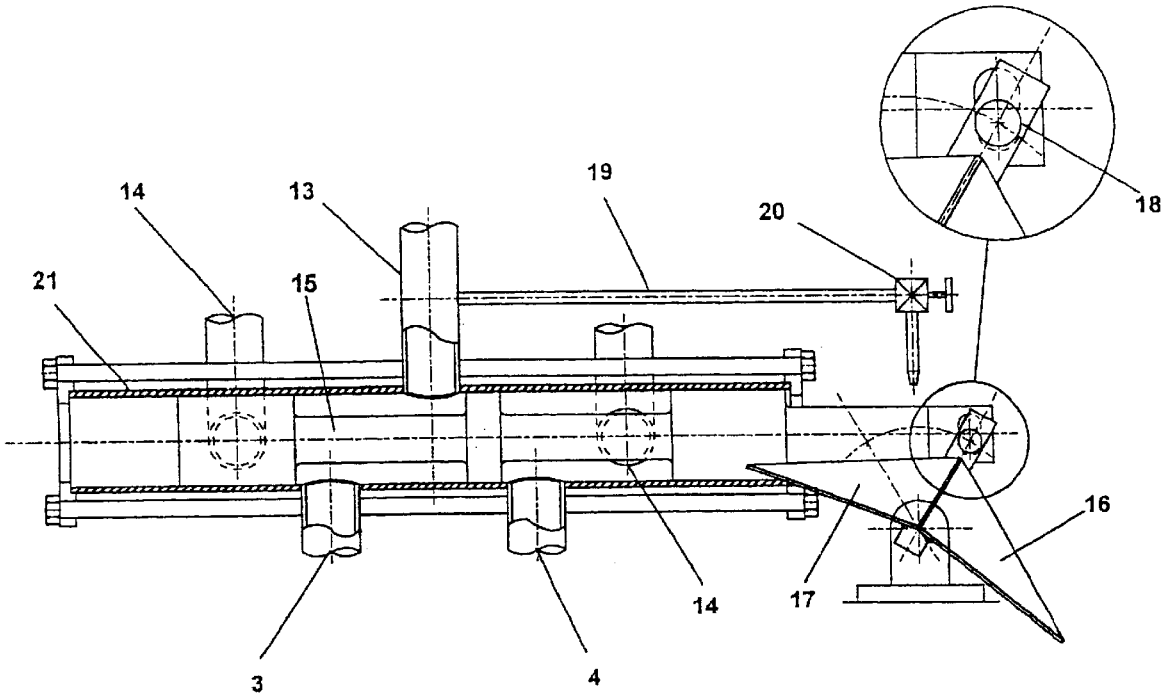
FIG. 3 is a sectional side view of the five-port control valve (spool type valve depicted) and tipping bucket.

On examining the drawings, particularly the general view of FIG. 1, it can be seen that the invention consists of two fundamental parts: the double-acting pump 23, shown also in FIG. 2 and the combined control valve 24 and tipping bucket 25, shown also in FIG. 3.

Refer first to FIG. 1 wherein the double-acting pump 23, the control valve 24 and the tipping bucket 25 are shown in relation to each other.

Refer now to FIG. 2 wherein the large diameter piston 2 in the low pressure cylinder 1 has completed its movement to the right propelled by low pressure water flowing through the left-hand side (lhs) inlet/exhaust pipe 3 from the control valve 24 in FIG. 3.

The large diameter piston 2 is coupled directly to the right-hand side (rhs) small diameter piston 8 with piston seal 22 in the rhs high pressure cylinder 7. Thus high pressure water already in this cylinder has been forced through the delivery non-return valve 10 to the delivery pipe 9 and thence to a storage tank (not shown) at some height above the pumping unit.

Meanwhile, water already in the low pressure cylinder 1 on the rhs of the large diameter piston 2 has been forced through the rhs inlet/exhaust pipe 4 back to the control valve 24 in FIG. 3.

At the same time, water has been drawn from a sump (not shown) into the lhs high pressure cylinder 5 through the lhs suction pipe 12 and the lhs suction non-return valve 11 by the right-ward movement of the lhs small diameter piston 6 with piston seal 22 coupled directly to the large diameter piston 2.

Refer now to FIG. 3 wherein the spool 15, contained in the valve body or cylinder 21, is fully to the right. The spool 15 may be articulated in order to take up alignment errors in the valve body 21.

Low pressure water from the supply pipe 13, which may take any configuration, enters the lhs of the control valve 24 and flows to the lhs of the low pressure cylinder 1 in FIG. 2 through the lhs inlet/exhaust pipe 3.

Meanwhile, water from the rhs of the low pressure cylinder 1 in FIG. 2 exhausts through the rhs inlet/exhaust pipe 4 and the rhs of the control valve 24 to the waste pipe 14.

At the same time, a small and constant amount of water bled from the supply pipe 13 flows through the bleed pipe 19 and manual valve 20 to the left-hand (lh) receptacle 17 of the'tipping bucket 25. This fills until the weight of water is sufficient to overcome the weight of the right-hand (rh) receptacle 16 of the tipping bucket 25 and the friction between the spool 15 and the valve body 21.

At this point, the tipping bucket 25 is permitted to rotate anti-clockwise through a small angle thus emptying the lh receptacle 17 of the tipping bucket 25 and presenting the rh receptacle 16 of the tipping bucket 25 for filling.

The tipping bucket 25 is linked to the spool 15 through a scotch yoke mechanism 18 and thus the anti-clockwise rotation moves the spool 15 fully to the left.

Low pressure water now flows from the supply pipe 13, enters the rhs of the control valve 24 and flows to the rhs of the low pressure cylinder 1 in FIG. 2 through the rhs inlet/exhaust pipe 4 thus moving the large diameter piston 2 to the left.

High pressure water in the lhs high pressure cylinder 5 is now delivered to the storage tank through the delivery non-return valve 10 and water is drawn into the rhs high pressure cylinder 7 from the sump through the suction non-return valve 11.

Meanwhile, water from the lhs of the low pressure cylinder 1 in FIG. 2 exhausts through the lhs inlet/exhaust pipe 3 and the lhs of the control valve 24 to the waste pipe 14.

This process continues until the weight of water in the rh receptacle 16 of the tipping bucket 25 is sufficient to rotate the tipping bucket 25 clockwise through the same small angle and thus move the spool 15 fully to the right.

The above cycle of operations repeats at a frequency determined by adjustment of the manual valve 20 which governs the flow of bled water into the tipping bucket 25.

I claim:

1. An integral pump and control valve, comprising;

(i) a pump having an axially reciprocating double-acting pumping means for generating a flow of high pressure water from a flow of low pressure water, wherein the pumping means is powered only by the low pressure water and includes a large diameter piston, (ii) a control valve having ports connected to the pump so as to operate the large diameter piston, the ports and pump being so arranged so that the low pressure water is admitted to the pump and waste water is exhausted from the pump alternately on opposite sides of the large diameter piston; and (iii) a tipping bucket comprising two receptacles for water which fill and empty alternately, the tipping bucket being connected to the control valve and being configured to move the control valve between two operating positions which control operation of the large diameter piston.

2. The device of claim 1, wherein the pump is of the hydraulic type for pumping water.

3. The device of claim 1, wherein the control valve is selected from one of a rotary, slide and spool type.

4. The device of claim 1, wherein the water supplied to the two receptacles of the tipping bucket is drawn from the supply of the low pressure water through a manual valve.

5. The device of claim 4, wherein the frequency of operation of the control valve is variable by adjusting the flow of the low pressure water to the tipping bucket by means of the manual valve.

6. The device of claim 1, wherein the pump, control valve and tipping bucket are included in a single housing as an integrated pumping unit.

7. The device of claim 3, wherein the spool is articulated.

8. The device of claim 7, wherein the pump and the control valve are fluidly connected by internal passageways within the housing.

9. The device of claim 1, wherein the pumping means is made from a material selected from metal, plastics, or from a combination of these materials.

10. The device of claim 1, wherein the pumping means further includes a first small diameter piston coupled to a first side of the large diameter piston and a second small diameter piston coupled to a second side of the large diameter piston, wherein the first and second sides of the large diameter piston are oppositely oriented.

* * * * *